US011761359B2

(12) United States Patent
Hagen et al.

(10) Patent No.: US 11,761,359 B2
(45) Date of Patent: Sep. 19, 2023

(54) HYDRAULIC UNIT OF AN ELECTROHYDRAULIC GAS EXCHANGE VALVE CONTROL SYSTEM

(71) Applicant: Schaeffler Technologies AG & Co. KG, Herzogenaurach (DE)

(72) Inventors: Christian Hagen, Nuremberg (DE); Calin Petru Itoafa, Höchstadt (DE); Robert Seeger, Schlüsselfeld (DE); Marco Meisborn, Höchstadt a.d. Aisch (DE); Murat Yakan, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/770,673

(22) PCT Filed: Sep. 30, 2020

(86) PCT No.: PCT/DE2020/100837
§ 371 (c)(1),
(2) Date: Apr. 21, 2022

(87) PCT Pub. No.: WO2021/078322
PCT Pub. Date: Apr. 29, 2021

(65) Prior Publication Data

US 2022/0381165 A1 Dec. 1, 2022

(30) Foreign Application Priority Data

Oct. 25, 2019 (DE) ..... 10 2019 128 826.6

(51) Int. Cl.
*F01L 9/14* (2021.01)

(52) U.S. Cl.
CPC ..... *F01L 9/14* (2021.01); *F01L 2301/00* (2020.05)

(58) Field of Classification Search
CPC ..... F01L 9/10; F01L 9/11; F01L 9/12; F01L 9/14; F01L 2301/00
(Continued)

(56) References Cited

U.S. PATENT DOCUMENTS 6,003,838 A 12/1999 Beck
2009/0000580 A1* 1/2009 Proschko ..... F01L 9/14 123/90.11
(Continued)

FOREIGN PATENT DOCUMENTS

DE 102006008676 A1 8/2007
DE 102007053981 A1 * 5/2009 ..... F01L 13/06
(Continued)

*Primary Examiner* — Jorge L Leon, Jr.

(57) ABSTRACT

The disclosure relates to a hydraulic unit of an electrohydraulic gas exchange valve control system of an internal combustion engine. The hydraulic unit includes a hydraulic housing having a receiving opening, a piston guide, and a slave piston. The piston guide is fastened in the hydraulic housing by way of self-staking with a wall of the receiving opening.

The piston guide includes an outer part that brings about the self-staking and an inner part that guides the slave piston. An inner surface of the outer part is radially interspaced from the outer surface of the inner part in an axial region of the self-staking and the outer part and the inner part are connected in an axially form-locked manner so that a first end section of the outer part facing the gas exchange valve is partially or fully formed into an outer circumferential recess of the inner part.

14 Claims, 3 Drawing Sheets

(58) Field of Classification Search
USPC ..... 123/90.12
See application file for complete search history.

(56) References Cited

U.S. PATENT DOCUMENTS

| | | | | |
|---|---|---|---|---|
| 2013/0174799 | A1* | 7/2013 | Itoafa | F01L 1/24 123/90.52 |
| 2014/0048024 | A1* | 2/2014 | Itoafa | F01L 9/10 123/90.12 |
| 2015/0122340 | A1* | 5/2015 | Edelmayer | F02N 19/00 137/154 |
| 2016/0341080 | A1* | 11/2016 | Itoafa | F01L 9/14 |

FOREIGN PATENT DOCUMENTS

| | | | | |
|---|---|---|---|---|
| DE | 102011002680 | A1 * | 7/2012 | F01L 9/025 |
| DE | 102011002680 | A1 | 7/2012 | |
| DE | 102011075894 | A1 | 11/2012 | |
| DE | 102013214651 | A1 | 5/2014 | |
| DE | 102014201911 | A1 | 8/2015 | |
| DE | 102019109865 | A1 | 11/2019 | |
| EP | 2060755 | A2 | 5/2009 | |

* cited by examiner

HYDRAULIC UNIT OF AN ELECTROHYDRAULIC GAS EXCHANGE VALVE CONTROL SYSTEM

CROSS-REFERENCE TO RELATED APPLICATIONS

This application is the U.S. National Phase of PCT Application No. PCT/DE2020/100837 filed on Sep. 30, 2020, which claims priority to DE 10 2019 128 826.6 filed on Oct. 25, 2019, the entire disclosures of which are incorporated by reference herein.

TECHNICAL FIELD

This disclosure relates to a hydraulic unit of an electrohydraulic gas exchange valve control system of an internal combustion engine.

BACKGROUND

Internal combustion engines with electrohydraulic valve control, in which the essential components required for hydraulic transmission from the master-side cam lifts to the slave-side gas exchange valves are arranged in a preassembled hydraulic unit attached to the cylinder head, have been in large-scale production for several years at the automobile manufacturer FIAT under the designation "Multiair".

The piston guides for the master piston on the cam side and the slave piston on the gas exchange valve side can be fastened by screwing them into the hydraulic housing, as suggested in DE 10 2006 008 676 A1.

As an alternative to this screw fastening, the piston guide for the master piston is to be joined to the hydraulic housing by means of a friction weld joint according to DE 10 2011 075 894 A1.

DE 10 2011 002 680 A1 discloses a hydraulic unit with a hydraulic housing made of light metal, the receiving opening of which for the piston guide is lined with a material that can be subjected to high mechanical stress.

In DE 10 2013 214 651 A1 and DE 10 2014 201 911 A1, it is proposed in each case to join the hydraulic housing and the piston guide for the master piston and the slave piston, respectively, by means of plastic material forming. In this process, the piston guide, which is made of relatively solid steel material, is pressed into the receiving opening of the hydraulic housing, which is made of relatively soft aluminum material, and the local interference of the piston guide causes a material flow from the housing wall into outer annular grooves of the piston guide. This form-lock connection that cannot be released again in a non-destructive manner is known from literature as self-staking.

The constriction of the housing wall associated with the radially inward material flow during self-staking inevitably leads to a radially inward deformation of the piston guide, wherein its cylindrical shape, which is necessary for the precise guidance of the slave piston, can be impaired to an unacceptably high degree.

A generic hydraulic unit is known from the subsequently published DE 10 2019 109 865 A1.

SUMMARY

It is the object of the disclosure to improve a hydraulic unit of the aforementioned type with regard to the constructive design of the self-staking piston guide of the slave piston.

This object is achieved in that the outer part and the inner part are connected to one another in an axially form-locked manner in that a first end section of the outer part facing the gas exchange valve is partially or fully formed into a recess of the inner part around the outer circumference.

According to the disclosure, the staking-induced deformation of the piston guide is absorbed in the radial (annular) gap between the outer part and the inner part and therefore remains largely or completely confined to the outer part. As a result, the guide bore of the inner part decoupled from the staking and supporting the slave piston is not deformed, or at least not to an impermissibly high degree. The outer part and the inner part are firmly connected to one another in that the non-hardened outer part is locally formed and the formed section with the recess creates an axial form fit which prevents relative displacement of the inner part in the direction of the gas exchange valve.

Example embodiments of the disclosure are further described herein.

BRIEF DESCRIPTION OF THE DRAWINGS

Further features of the disclosure result from the following description and from the figures, which show an exemplary embodiment of the disclosure. The explanation of the exemplary embodiment is based on the prior art according to FIGS. 1 to 4. Unless otherwise mentioned, features or components that are the same or functionally the same are provided with the same reference signs. In the figures.

DETAILED DESCRIPTION

Figure 1:
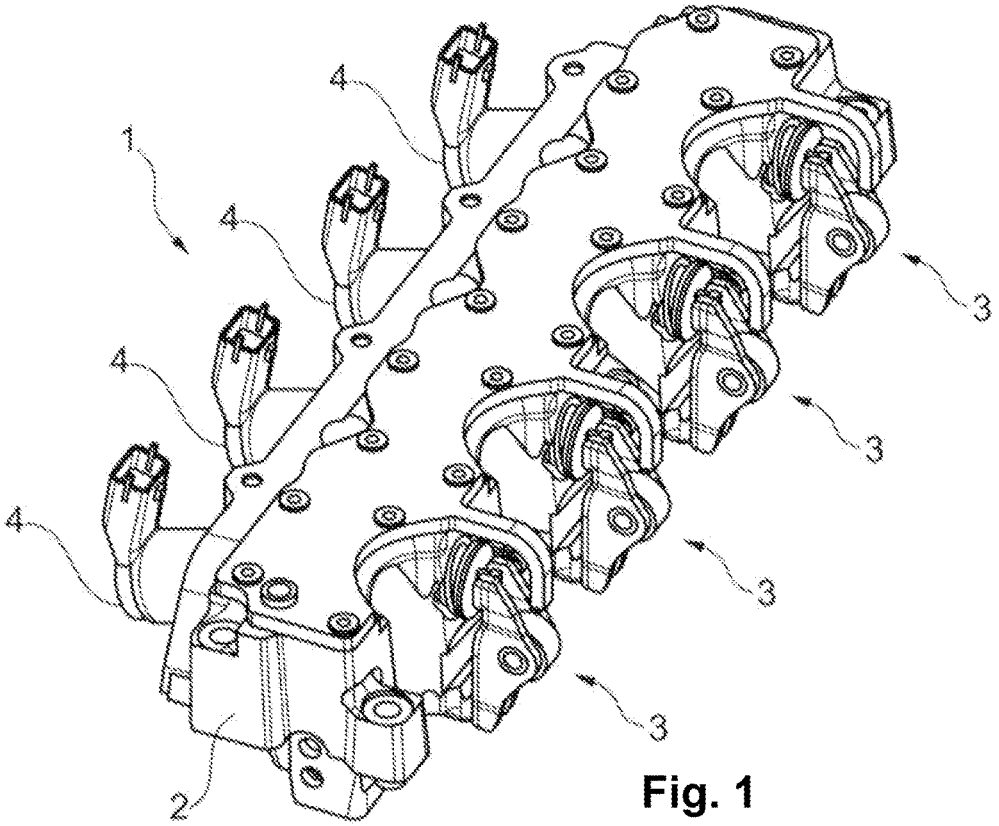
Fig. 1 (Prior Art)
FIG. 1 shows a known hydraulic unit of an electrohydraulic gas exchange valve control system in a perspective view.

FIG. 1 shows an overall view of a known hydraulic unit 1 which is preassembled for installation in a cylinder head of an inline four-cylinder internal combustion engine with electrohydraulic control of the gas exchange valves. A hydraulic housing 2 connected to the oil circuit of the internal combustion engine accommodates master units 3 driven by the cams of a camshaft not shown. Electromagnetic hydraulic valves 4 are located on the longitudinal side of the hydraulic housing 2 opposite the master units 3.

Figure 2:
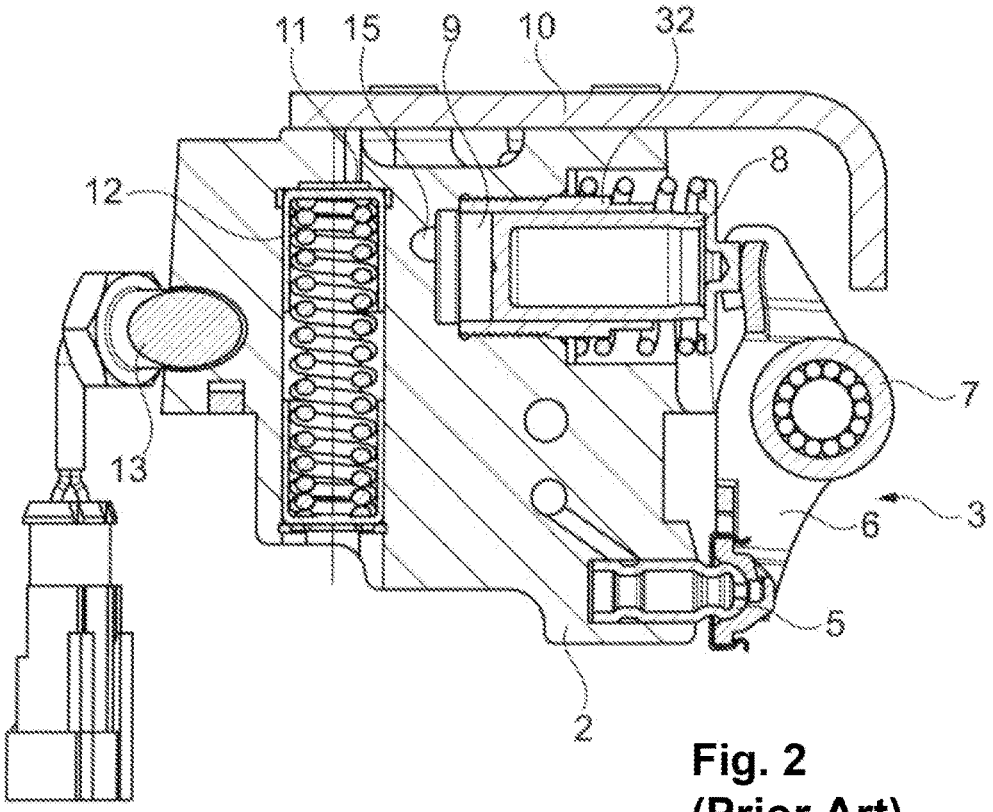
Fig. 2 (Prior Art)
FIG. 2 shows a cross-section through the hydraulic unit along a master unit mounted therein.

A cross-section through one of the identical master units 3 is shown in FIG. 2. As a cam follower, the master unit 3 comprises a rocker arm 6 pivot-mounted on a rigid support element 5 with a needle-mounted roller 7 as a cam tap, a spring-loaded master piston 8 and a piston guide 32 screwed into the hydraulic housing 2, in which the master piston 8 is axially movably guided. The cam lift is transmitted on the outside of the housing to the master piston 8, which delimits a variable-volume pressure chamber 9 on the inside of the housing. In order to control the hydraulic medium pressures occurring in the pressure chamber 9 in a region of 200 bar plus pressure peaks due to the pressure pulsations in terms of material, the hydraulic housing 2, which is closed by a housing cover 10 screwed to it, is designed as a pressure-tight aluminum forging. When the hydraulic valve 4 is open, the pressure chamber 9 is connected to a pressure relief chamber 11, which in turn is delimited by a spring-loaded piston 12 of a pressure accumulator. A sensor 13 screwed into the hydraulic housing 2 is used to detect the hydraulic medium temperature.

Figure 3:
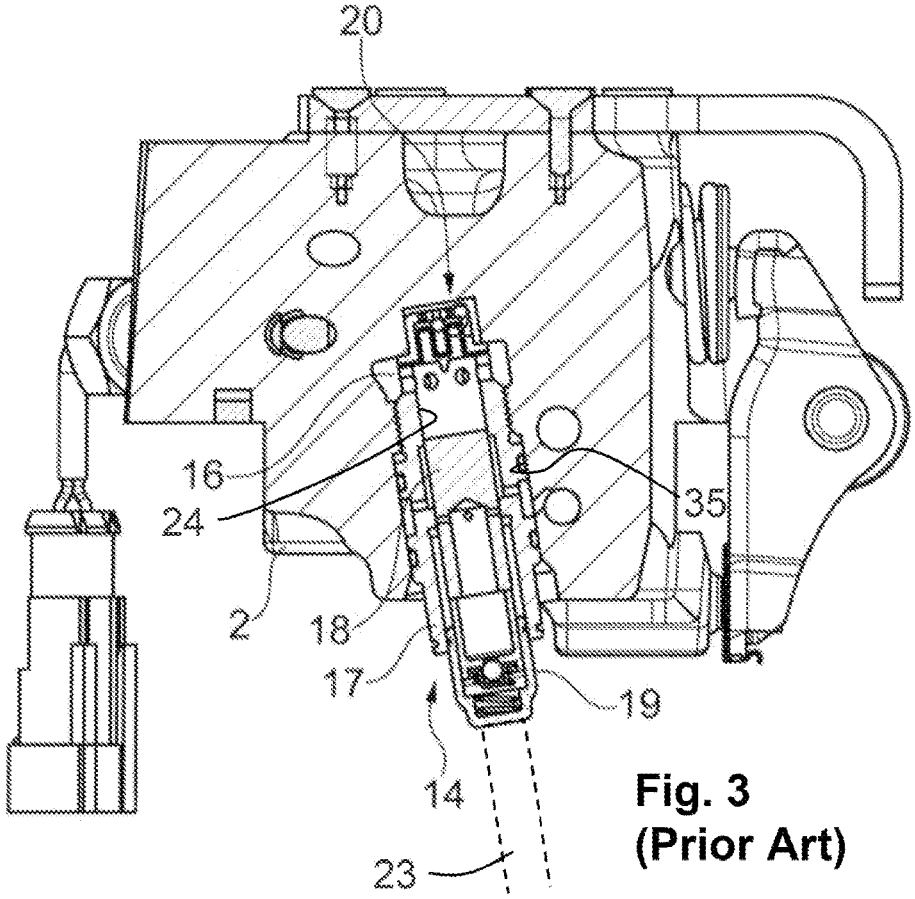
Fig. 3 (Prior Art)
FIG. 3 shows a cross-section through the hydraulic unit along a slave unit mounted therein.

FIG. 3 shows a slave unit 14 for actuating one of the gas exchange valves 23, indicated here by a dashed line. The slave unit 14 is in a hydraulic operative connection with the master piston 8 of the master unit 3 via channels 15 and 16 as shown in FIGS. 2 and 3. The slave unit 14 comprises a cylindrical piston guide 17, which is screwed into a receiving opening 35 of the hydraulic housing 2, a slave piston 18, which is axially movably guided in a guide bore 24 of the piston guide 17, and delimits the pressure chamber 9 on the inside of the housing and actuates the gas exchange valve 23 on the outside of the housing via a hydraulic valve clearance compensation element 19, and a hydraulic valve brake 20. This ensures defined braking and gentle closing of the gas exchange valve 23, which is hydraulically decoupled from the associated cam lift during the lifting phase and is acted upon in the closing direction by its valve spring, while a rapid outflow of hydraulic medium from the pressure chamber 9 into the pressure relief chamber 11 occurs when the hydraulic valve 4 is open.

Figure 4:
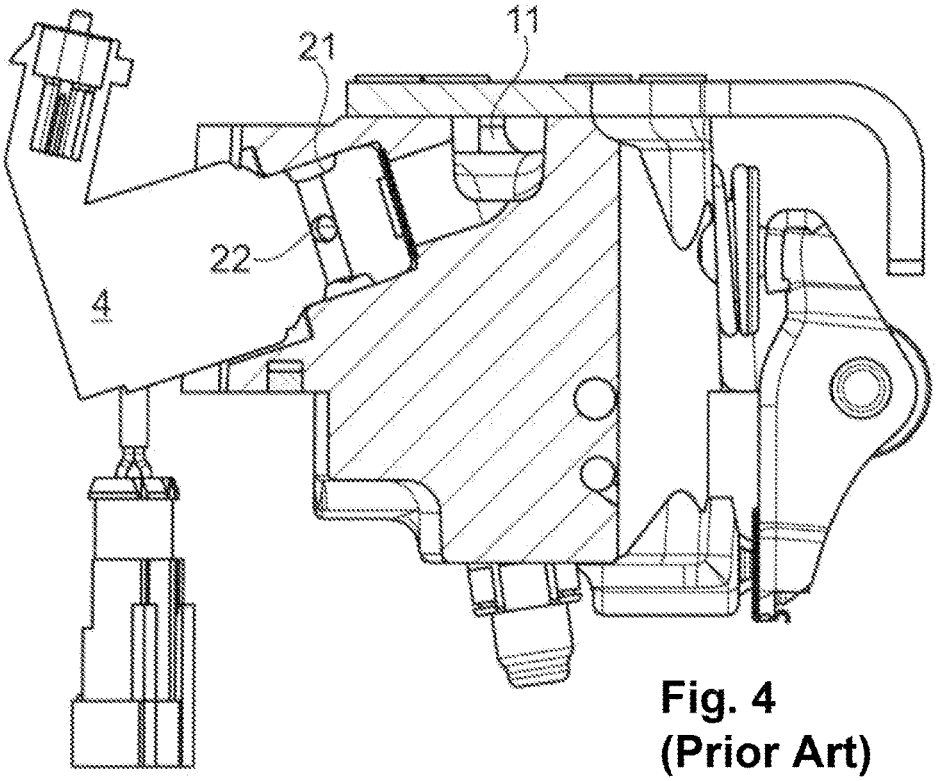
Fig. 4 (Prior Art)
FIG. 4 shows a cross-section through the hydraulic unit along a hydraulic valve mounted therein.

The separation of the pressure chamber 9 from the pressure relief chamber 11 by the hydraulic valve 4 is evident from the cross-section along the hydraulic valve 4 shown in FIG. 4. The channels 15 and 16 are hydraulically connected to one another via an annular groove 21 extending at the hydraulic valve 4, so that the annular groove 21 is part of the pressure chamber 9, as are the channels 15 and 16. When open, the hydraulic valve 4 allows hydraulic fluid to flow from the pressure chamber 9 into the pressure relief chamber 11 and back through a bore 22 connecting the pressure relief chamber 11 to the annular groove 21.

The hydraulic valve 4 and the hydraulic housing 2 are inseparably joined by means of a self-staking known per se. In contrast, it is not possible without additional measures to replace the screw fastening of the piston guide 17 with such a self-staking in the hydraulic housing 2 in order to avoid the disadvantages and risks with regard to the comparatively high manufacturing and assembly effort or premature loosening of the screw connection. The reason for this is the guide clearance of only a few micrometers between the slave piston 18 and the guide bore 24, whose radially inward deformation as a result of self-staking would be much greater than the guide clearance and would therefore lead to the slave piston 18 jamming in the guide bore 24.

Figure 5:
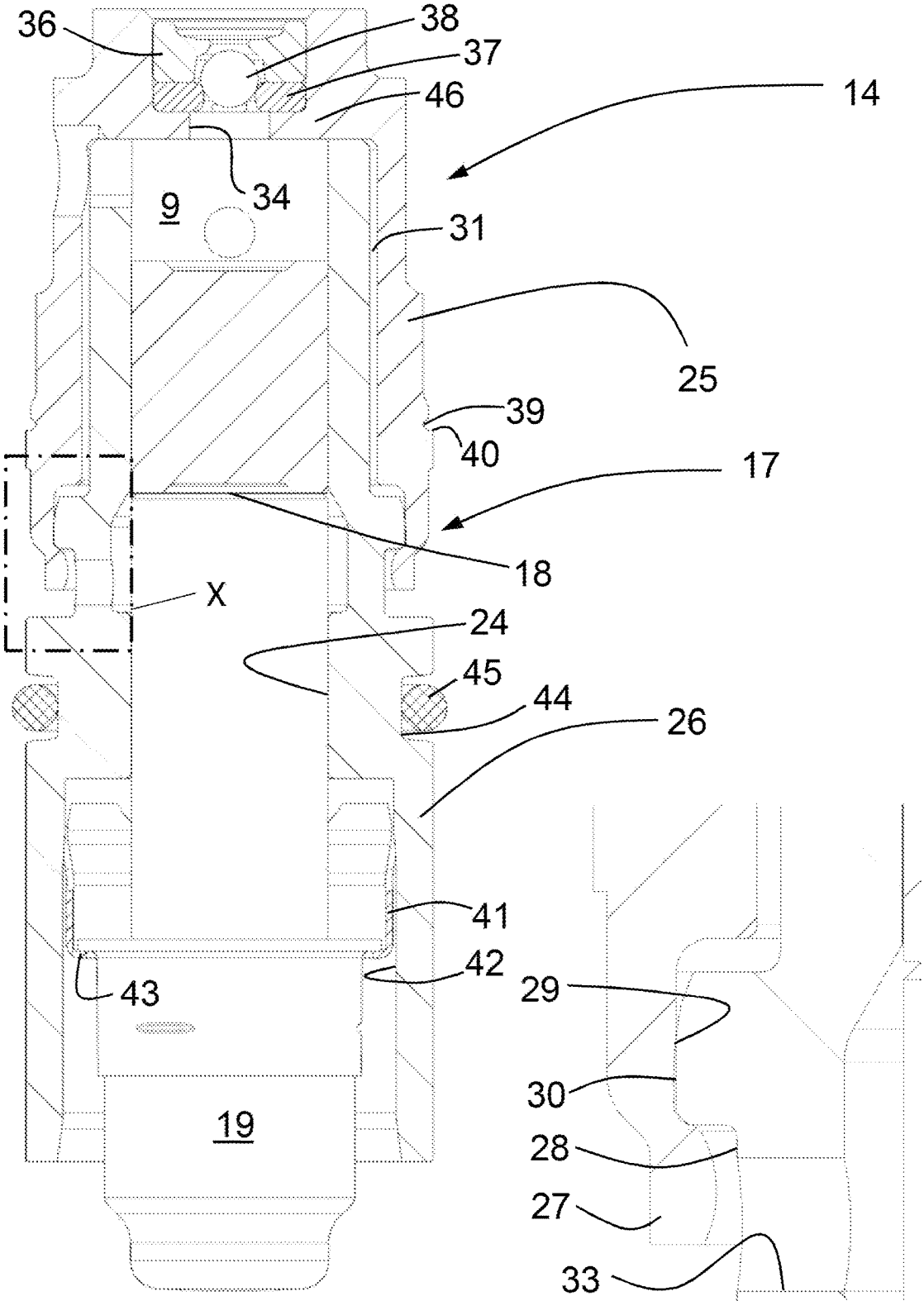
FIG. 5 shows an exemplary embodiment of a slave unit with a piston guide according to the disclosure in a longitudinal sectional view.

This problem is solved by the multi-part design of the piston guide 17 of a slave unit 14 according to the disclosure, which will be explained below with reference to the exemplary embodiment shown in FIGS. 5 and 6. The piston guide 17 has a multi-part design with an outer part 25 and an inner part 26 firmly connected thereto. The fastening is mainly brought about by an axial form-locked connection and additionally by an interference fit. The axial form-locked connection consists of a first end section 27 of the outer part 25 facing the gas exchange valve 23 radially overlapping with an outer circumferential recess of the inner part 26. The recess is an annular groove 28. After insertion of the inner part 26 into the outer part 25, the overlap is created by the first end section 27 being formed partially circumferentially or, as in the present case, fully circumferentially in the radially inward direction into the annular groove 28. Forming is carried out by means of known stamping, staking or roller burnishing processes.

Figure 6:
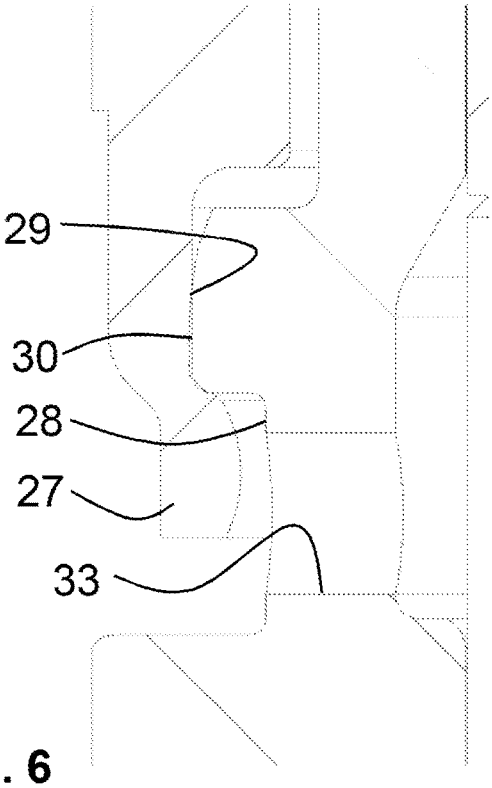
FIG. 6 shows the detail X according to FIG. 5.

The interference fit supporting the form-locked connection, which is shown enlarged in FIG. 6, exists between an inner surface section 29 of the outer part 25 adjacent to the first end section 27 and an outer surface section 30 of the inner part 26 adjacent to the annular groove 28. The outer part 25 and the inner part 26 are connected to one another in a hydraulically sealing manner in an interference fit, so that an uncontrolled outflow of hydraulic medium from the pressure chamber 9 via an annular gap 31 between the outer part 25 and the inner part 26 is prevented with regard to the function of the hydraulic valve brake 20. The slave piston 18 includes the hydraulic valve clearance compensation element 19, the hydraulic supply for which is affected via an opening 33 which passes transversely through the inner part 26 in the axial region of the annular groove 28.

The second end section of the outer part 25 on the inside of the housing, i.e., facing away from the gas exchange valve 23, has a bottom 46 which axially supports the inner part 26 resting against it on the end face. The piston guide 17 has a constructively integrated check valve, which makes it possible to test the slave unit 14, in particular, regarding the proper functioning of the hydraulic valve brake 20 before it is fastened in the hydraulic housing 2. The check valve opens toward the slave piston 18 to allow hydraulic fluid flow into the pressure chamber 9 through an opening 34 in the bottom 46, and includes a valve ball 38, a first valve seat 36 pressed into the bottom 46, and a second valve seat formed either by the bottom 46 itself or, as in the present case, by a disc 37 axially clamped between the bottom 46 and the first valve seat 36. The valve ball 38 rests sealingly on the first valve seat 36 when the check valve is closed and on the disc 37 when the check valve is open. An advantage of the additionally inserted disc 37 is that the disc 37, unlike the outer part 25, is hardened for the benefit of a permanent wear resistance of the second valve seat. Another advantage is the shaping of the second valve seat, which is much easier to produce on the flat disc 37 than in the comparatively deeply recessed bottom 46.

Both the outer part 25 and the inner part 26 are made of a steel material. Only the inner part 26 has the surface wear resistance of the guide bore 24 required with regard to the axial guidance of the slave piston 18 and is hardened for this purpose. In contrast, the outer part 25 is manufactured without heat treatment for the benefit of forming and also to achieve low manufacturing costs. For the purpose of self-staking with the even "softer" wall of the receiving opening 35 of the hydraulic housing 2 (made of aluminum), the outer surface of the outer part 25, which is thus made of "soft" steel material, is provided with an annular groove 39 and a diameter step 40 delimiting it, which, in the undeformed state, overlaps so strongly with the diameter of the receiving opening 35 that pressing the piston guide 17 into the hydraulic housing 2 causes a local material flow of the wall into the annular groove 39, as a result of which the piston guide 17 is non-releasably fastened in the receiving opening 35 in a form-locked manner.

The multi-part design of the piston guide 17 allows the outer surface of the inner part 26 to be radially interspaced from the inner surface of the outer part 25 in the axial region of the self-staking, i.e., at least locally in the axial region of the annular groove 39. The correspondingly large annular gap 31, which in the present case extends at least before self-staking from the bottom 46 to the radially projecting outer surface section 30 of the inner part 26, is dimensioned in such a way that the radial deformation of the outer part 25 inevitably accompanying the staking of the receiving opening 35 is not transferred, or is not transferred significantly, to the inner part 26 and consequently its guide bore 24 retains the cylindrical shape with a small and narrow-tolerance guide clearance required for the exact guidance of the slave piston 18. The dimension of the undeformed annular gap is a few tenths of a millimeter.

The slave piston 18 is secured against axial extension from the piston guide 17 by means of a clamping sleeve 41. The clamping sleeve 41 is in clamping contact with the inner surface section 42 of a stepped bore in the inner part 26 on the outer circumference and is held therein so as to be axially displaceable against the clamping contact force. A radially inward collar 43 of the clamping sleeve 41 serves as an axial stop for the valve clearance compensation element 19, which is thus held in the retracted position shown. This state exists until the hydraulic unit 1 is mounted in the internal combustion engine and put into operation, so that the hydraulic actuation of the slave piston 18 displaces the clamping sleeve 41 into the extended operating position.

The inner part 26 is provided with another annular groove 44 and a sealing ring 45 inserted therein to seal the hydraulic supply to the valve clearance compensation element 19 relative to the mouth of the receiving opening 35.

The invention claimed is:

1. A hydraulic unit of an electrohydraulic gas exchange valve control system of an internal combustion engine, the hydraulic unit comprising:

a hydraulic housing including a receiving opening, a piston guide including an outer part fastened within the receiving opening via a self-staking, and an inner part axially received within the outer part, and a slave piston movably guided within the inner part, the slave piston configured to: i) delimit, in the hydraulic housing, a pressure chamber extending into the piston guide, and ii) actuate a gas exchange valve arranged outside of the hydraulic housing, wherein an inner surface of the outer part is radially spaced apart from an outer surface of the inner part in an axial region of the piston guide corresponding to the self-staking, and wherein the outer part and the inner part are connected to each other such that a first axial end section of the outer part closest to the gas exchange valve is at least partially engaged with an outer circumferential recess formed in the inner part.

2. The hydraulic unit of claim 1, wherein the outer circumferential recess is an annular groove.

3. The hydraulic unit of claim 2, wherein the annular groove includes a transverse opening configured to communicate a hydraulic medium to a hydraulic valve clearance compensation element arranged in the inner part.

4. The hydraulic unit of claim 1, wherein an inner surface section of the outer part adjacent to the first axial end section is hydraulically sealed against an outer surface section of the inner part adjacent to the outer circumferential recess via an interference fit.

5. The hydraulic unit of claim 1, wherein the hydraulic housing is constructed of aluminum, and the outer part is constructed of steel.

6. The hydraulic unit of claim 5, wherein the steel of the outer part is free from a heat treatment surface configured to increase a surface hardness of the outer part.

7. The hydraulic unit of claim 1, wherein a second axial end section of the outer part furthest from the gas exchange valve includes a bottom configured to support an axial end face of the inner part.

8. The hydraulic unit of claim 7, wherein the outer part further includes a check valve configured to open towards the slave piston, the check valve including:

a valve ball, a first valve seat pressed into the bottom, and a second valve seat formed by one of the bottom or a disc clamped axially between the bottom and the first valve seat, wherein the valve ball rests against the first valve seat when the check valve is closed, and wherein the valve ball rests against the second valve seat when the check valve is open.

9. A hydraulic unit of an electrohydraulic gas exchange valve control system of an internal combustion engine, the hydraulic unit comprising:

a hydraulic housing including a receiving opening, a piston guide including:

an outer part configured to be fixed within the receiving opening via a self-staking, the outer part including an axial end section, and an inner part axially received within the outer part such that an annular gap is formed between an outer surface of the inner part and an inner surface of the outer part, the annular gap arranged in an axial region of the piston guide corresponding to the self-staking, the inner part including an outer circumferential recess configured to receive the axial end section of the outer part so as to attach the inner part to the outer part, and a slave piston movably guided in the piston guide, the slave piston configured to actuate a gas exchange valve.

10. The hydraulic unit of claim 9, further comprising a hydraulic valve configured to be hydraulically connected to a variable-volume pressure chamber delimited by the slave piston.

11. The hydraulic unit of claim 10, wherein the variable-volume pressure chamber is hydraulically connected to a pressure relief chamber when the hydraulic valve is open.

12. The hydraulic unit of claim 9, wherein the self-staking is defined by an annular groove arranged on the outer part.

13. The hydraulic unit of claim 12, wherein the self-staking is further defined by a diameter step arranged on the outer part which delimits the annular groove.

14. A hydraulic unit of an electrohydraulic gas exchange valve control system of an internal combustion engine, the hydraulic unit comprising:

a hydraulic housing including a receiving opening, a piston guide including:

an outer part configured to be disposed within the receiving opening, the outer part including an axial end section, an inner part disposed within the outer part, the inner part including an outer circumferential recess configured to receive the axial end section of the outer part so as to attach the inner part to the outer part, a slave piston movable guided within the inner part, the slave piston configured to: i) actuate a gas exchange valve, and ii) be hydraulically connected to a hydraulic valve.

* * * * *